United States Patent [19]

Bennison et al.

[11] Patent Number: 4,504,183

[45] Date of Patent: Mar. 12, 1985

[54] BAG OPENING MACHINE

[75] Inventors: Stewart Bennison, Chesterfield; Ronald L. Linnik, Denton, both of England

[73] Assignee: JSK Company Ltd., Derbyshire, England

[21] Appl. No.: 346,269

[22] Filed: Feb. 5, 1982

[30] Foreign Application Priority Data

Feb. 14, 1981 [GB] United Kingdom ..... 8104670

[51] Int. Cl.[3] ..... B65G 65/04

[52] U.S. Cl. ..... 414/412; 53/381 R; 198/693

[58] Field of Search ..... 53/381 R; 414/411, 412; 198/693

[56] References Cited

U.S. PATENT DOCUMENTS

| | | | |
|---|---|---|---|
| 395,498 | 1/1889 | Lund | 198/693 X |
| 1,506,843 | 9/1924 | Komarnisky | 198/693 |
| 2,385,829 | 10/1945 | Melroe | 198/693 |
| 3,664,530 | 5/1972 | Takiguchi | 414/412 |
| 3,735,856 | 5/1973 | Van Der Lely et al. | 198/693 X |
| 3,757,973 | 10/1973 | Lambert et al. | 414/412 X |
| 4,289,438 | 10/1981 | Murer | 414/412 |

FOREIGN PATENT DOCUMENTS

| | | | |
|---|---|---|---|
| 2218026 | 11/1973 | Fed. Rep. of Germany | 414/412 |
| 197802 | 2/1978 | France | 414/412 |
| 2060545 | 5/1981 | United Kingdom | 414/412 |
| 2096089 | 10/1982 | United Kingdom | 414/412 |

*Primary Examiner*—Robert L. Spruill
*Assistant Examiner*—Steven P. Weihrouch
*Attorney, Agent, or Firm*—Oblon, Fisher, Spivak, McClelland & Maier

[57] ABSTRACT

A bag opening machine has an endless conveying band provided with spikes which conveys a bag (impaled on the spikes thereof—when in an extended position) to and past cutting means which act to make a continuous cut around three sides of the bag so that after cutting thereof it comprises two halves joined only at the rear or trailing side of the bag, unfolds the two halves of the bag as the half thereof engaged by said spike members is drawn to the forward end of the conveyor, thus to empty the contents of the bag into receiving means therefor and releases the emptied bag (by retraction of said spike members) to collection means therefor.

10 Claims, 4 Drawing Figures

BAG OPENING MACHINE

This invention concerns a bag opening machine of the kind (hereinafter termed "of the kind referred to") which receives bags, usually but not necessarily in the form of sacks made from paper or sheet plastics material, and feeds them past means for cutting the bags to permit them to be opened for emptying.

Many kinds of bag opening and emptying machine are known. Commonly encountered problems include the need to orientate and position the bags with some accuracy before presenting them to the cutting means and not wholly complete emptying either on account of the way in which the bag is cut or subsequently manipulated for emptying.

It is an object of the present invention to provide a bag opening machine which overcomes, at least to some extent, the problems aforesaid.

According to the present invention, there is provided a bag opening machine comprising a conveyor in the form of an endless band carried by rear and forward guide rollers and equipped with spike members which can be extended outwardly from and retracted inwardly of the conveying surface of the band and means for feeding a bag to be opened and emptied to the conveyor, which is arranged:

(i) to convey the bag (impaled on the spikes thereof—when in their extended positions) to and past cutting means which act to make a continuous cut around three sides of the bag so that after cutting thereof it comprises two halves joined only at the rear or trailing side of the bag (ii) to allow the two halves of the bag to unfold as the half thereof engaged by said spike members is drawn to the forward end of the conveyor, thus to empty the contents of the bag into receiving means therefor and (iii) to release the empty bag (by retraction of said spike members) to collection means therefor.

The invention will be further apparent from the following description, with reference to the figures of the accompanying drawings, which show, by way of example only two forms of bag opening machine embodying the invention.

Figure 1:
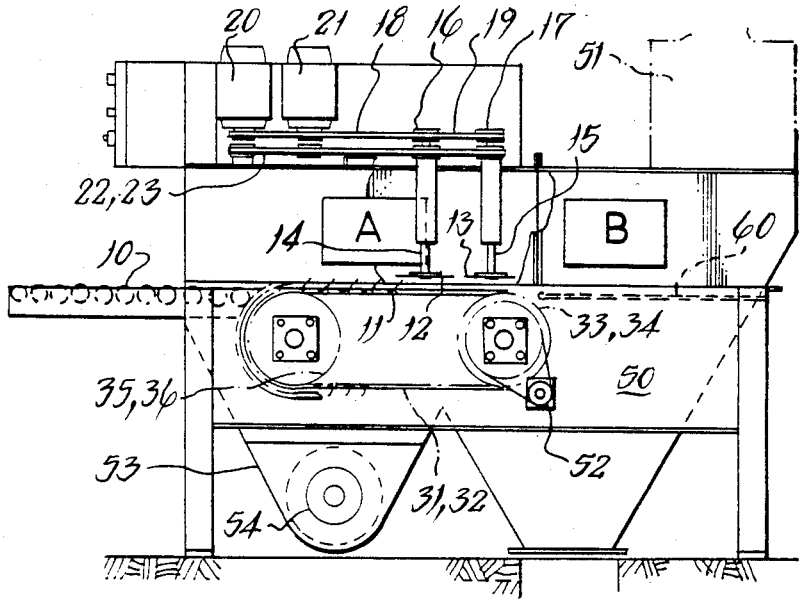
FIG. 1 shows a side elevation of one form of the machine.
Figure 2:
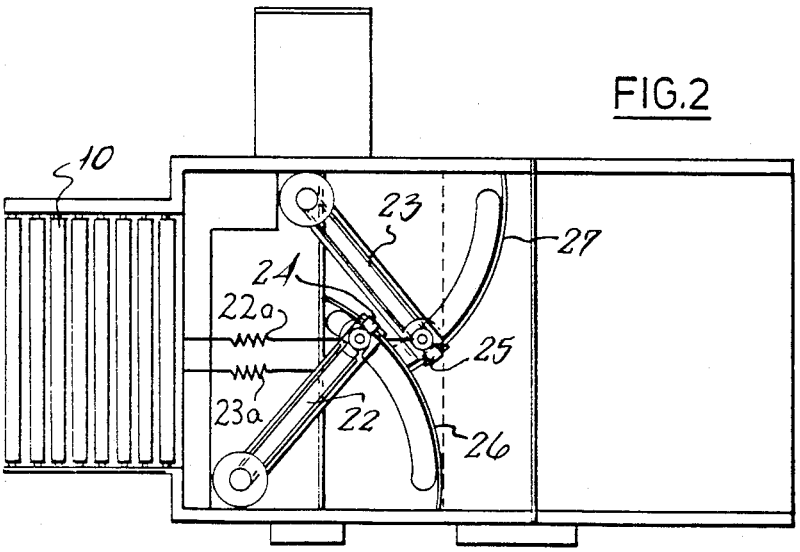
FIG. 2 shows a plan view of the machine of FIG. 1.

Referring to FIG. 1 of the drawings, it will be seen that bags to be opened and emptied are fed into the machine by a roller conveyor 10, which transfers them to a spiked conveyor 11 (in the form of an endless band and whose construction will be described in greater detail hereinafter) which carries them through a cutting station, generally indicated at A, and to an emptying station, generally indicated at B. Precise positioning and orientation of the bags on conveyor 10 and hence conveyor 11 is not required as will become apparent hereinafter.

At the cutting station A are two rotatable cutting discs 12 and 13, disposed in a horizontal plane and mounted for rotation on vertically extending shafts 14 and 15 respectively which carry, on their upper ends, drive pulleys 16 and 17 driven by V-belts 18 and 19 by drive motors 20 and 21. The shafts 14 and 15 are carried in bearings at the end of arms 22 and 23 mounted for pivotal movement at the axes of the motors 20 and 21. The arms 22 and 23 are free to turn about the axes of the drive motors and are equipped with rollers 24 and 25 running on arcuate tracks 26 and 27 for support. The arms 22 and 23 are urged inwardly and rearwardly by resilient spring means (not shown) to position the cutting discs 12 and 13 substantially centrally of the path along which the bags are conveyed by the conveyors 10 and 11. Most importantly, one of the arms, here 23, is positioned behind the other for reasons which will be discussed hereinafter.

Figure 3:
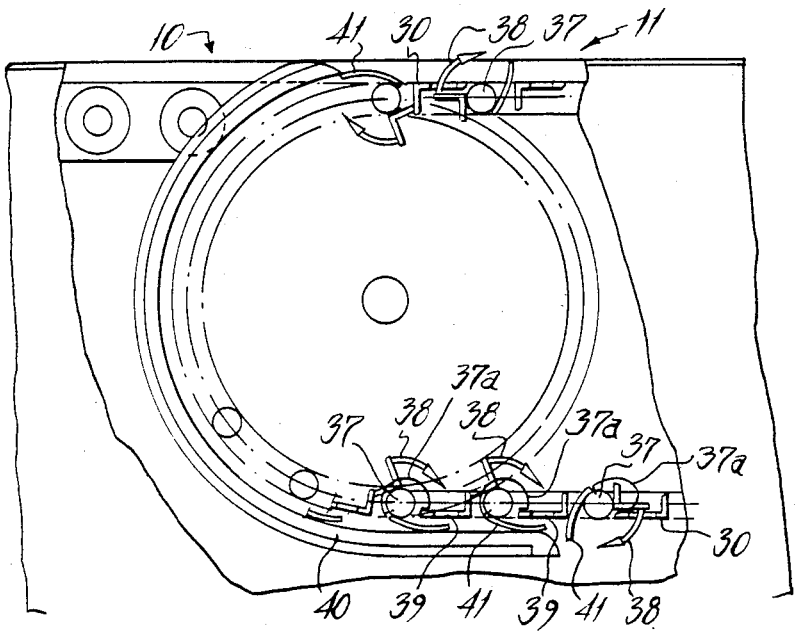
FIG. 3 shows an enlarged fragmentary view of the spiked conveyor of the machine of FIG. 1.

Referring now to FIG. 3, it will be seen that the spiked conveyor 11 is formed from a plurality of transversely extending slats 30 extending between endless chains 31,32 carried on rear sprocket wheels 35,36 and front sprocket wheels 33,34 comprising guide rollers. Associated with each slat 30 is a rod 37 rotatable relative to the chains 31,32 and carrying a plurality of transversely spaced curved spikes 38 which are urged by torsional springs **37*a* into a position where they protrude outwardly of the conveying surface of the slats 30 through apertures 39 therein. At one side of the spiked conveyor 11 and extending rearwardly from a position midway along the lower run of the chains 31,32 and following the path of the chains to a position adjacent the feeding end of the roller conveyor 10 is a cam member 40. Each of the rods 37 is provided with a cam follower 41 which engages with the cam 40 whilst the rods pass over the cam 40 to cause the spikes 38 to retract inwardly of the conveying surface defined by the slats 30 (see FIG. 3**).

In use bags are fed by the roller conveyor 10 towards the spiked conveyor 11. As successive rows of spikes 38 approach the underside of bags so conveyed they are released by disengagement of the cam followers 41 from the cam 40 to impale themselves into the bag under the action of the torsional springs and carry the bag forwardly through the cutting station A. The bag thus encounters the rearmost cutting disc 12 which penetrates the bag envelope and which is then forced forwardly and laterally by continued progress of the bag to cut half of the leading edge of the bag and down one side of the bag. Shortly after the cutting disc 12 has begun to move laterally the bag is brought into engagement with the cutting disc 13 at precisely the same position as the disc 12 first contacted the bag. In similar manner the cutting disc 13 is forced forwardly and laterally by continued progress of the bag to complete the cut through the leading edge of the bag and down the other side the of the bag. As the bag reaches the end of the spiked conveyor 11 the lowermost portion of the envelope of the bag which is securely impaled on the spikes 38 (which may comprise two sets—curved in opposite directions respectively) is pulled downwardly from the remainder of the bag which is supported as it is fed over the forward guide roller before it is drawn rearwardly to follow the lower part of the bag over the forward guide roller by a screen 60 (which may be comprised by a single rod) overlying a collection hopper 50 into which the contents of the bag fall and which may be equipped with dust extraction means 51. The envelope of the bag is conveyed by the spiked conveyor 11 past rotating brush means 52, preferably of spiral construction so as to have the effect of opening out any creases in the bag so as to complete removal of any material which remains adhering to the envelope of the bag. The bag envelope is conveyed rearwardly and released from the spiked conveyor 11 by retraction of the spikes 38 to fall into a bag collection chute 53 equipped with a screw 54 which serves to compact and convey the empty bag to suitable disposal means, such as a collection sack or the like.

Since the length of the empty bag where it is removed is twice that of the uncut bag, the conveyor 10 is arranged to run at half the linear speed of the spiked conveyor 11 whereby the machine will handle, without interruption, a continuous supply of bags from the conveyor 10.

The shafts 14 and 15 are preferably adjustable as to height relative to the arms 22 and 23 to enable the machine to be set up to deal with bags of different size. Clearly the cutting discs 12 and 13 should always be at the same level to ensure that they each engage the bag in turn at an identical position to ensure a continuous cut around the bag, facilitating the sure emptying of its contents as the undersurface of the bag envelope is peeled from the remainder at the emptying station.

Figure 4:
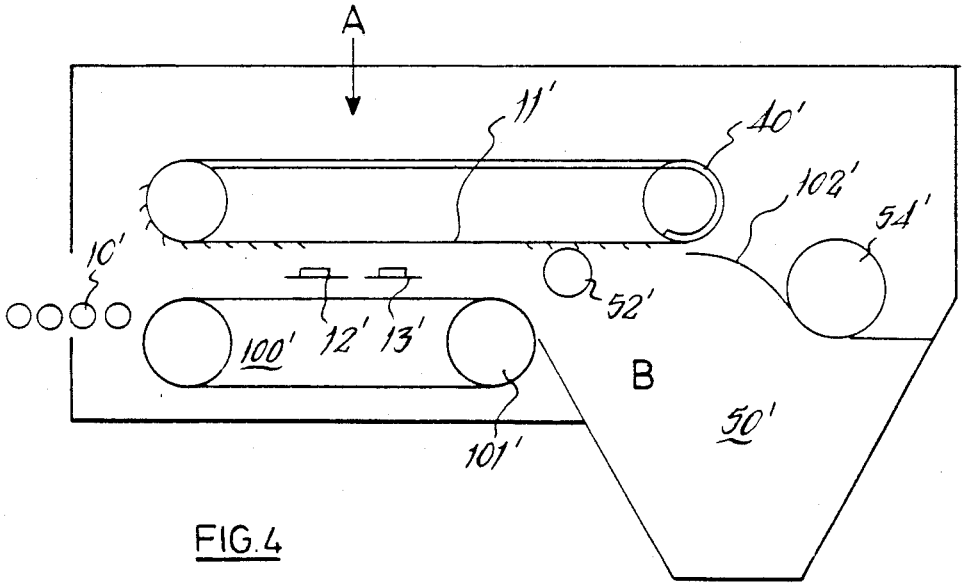
FIG. 4 shows a side elevation of a second form of the machine.

Turning now to FIG. 4, wherein like parts are indicated with like reference numerals, it will be seen that in an alternative embodiment of the machine, the spiked conveyor 11, which is of identical construction to that of the machine of FIG. 1, is located above the path of travel of the bags through the machine, an additional flat bed conveyor 100 being located beneath the path to support the weight of the bags as they are drawn through the cutting station A.

The cutting means is similar to that of the earlier described embodiment, the pivotal arms carrying the cutting discs 12 and 13 extending, respectively, from opposite sides of the machine into the space between the conveyors 11 and 100.

In this embodiment, the conveyor 11 extends forwardly of the conveyor 100 so that the lower halves of the cut bags, as the hinge line between the two halves thereof pass the forward guide roller 101 of the conveyor 100, can hang downwardly into the collection hopper 50, before being carried over the brush 52, to ensure complete removal of the contents to the hopper 50.

As in the earlier described embodiment a cam 40 is provided, which allows the spikes 38 to spring outwardly so impale the bags at the rear end of the conveyor 100. In this arrangement, however, the cam 40 acts to retract the spikes 38 to release the bags at the forward end of the conveyor 100; the empty bags being guided by a chute 102 to the collecting screw 54, which is located at the forward end of the machine.

This embodiment is especially suitable for deep bags, since the sides do not tend to fold inwardly to trap material at the forward end of the conveyor, or for bags of light weight which do not tend to be displaced by the cutting operation since during such operation they are firmly held in the nip between the conveyors 11 and 100.

It will be appreciated that it is not intended to limit the invention to the above example only, many variations, such as might readily occur to one skilled in the art, being possible, without departing from the scope thereof as defined by the appended claims.

We claim:

1. A bag opening and emptying machine comprising:

a substantially horizontal conveyor upon which said bag is conveyed, said conveyor comprising an endless band carried by rear and forward guide rollers, spike members extendible outwardly from and retractable inwardly of a conveying surface of the band, means for feeding a bag which is to be opened and emptied onto the surface of said horizontal conveyor, means for extending said spike members from the surface of the band so as to impale the bag and firmly secure it to the conveyor, cutting means adjacent the conveyor past which the bag is conveyed in a conveying direction and which serve to make a continuous cut around three sides of the bag whereby the bag is cut into upper and lower halves hingedly joined at the rear or trailing side of the bag, the conveyor serving to convey one half of the bag impaled on the spike members over the forward guide roller while the other half unfolds therefrom to release the contents of the bag, receiving means for collection of the contents of the bag, means for retracting said spike members to release the empty bag from the conveyor, and collection means for the empty bag,

2. A bag opening machine according to claim 9, wherein the conveyor is located beneath the path over which the bags travel and unfolds the two halves of the bag by drawing the half thereof engaged by said spike members over the forward guide rollers, including screen means to support the upper half of the bag envelope as it is fed over the forward guide roller and before it is drawn rearwardly to follow the lower half around the forward guide roller.

3. A bag opening machine according to claim 1, wherein the conveyor is located above the path of travel of the bags through the machine and extends forwardly of a further conveyor which supports the weight of the bags as they pass the cutting means and wherein said collection means are positioned at the forward end of the machine.

4. A bag opening machine according to claim 1, wherein said endless band includes transversely extending rods rotatable relative to said conveying surface of the band and carrying said spike members, said endless band including cam means and resilient means urging said rods to a position where the spike members protrude outwardly from the conveying surface, and a cam follower member associated with each said rod each said cam follower member cooperating with said cam means such that the rods are rotated against the action of said resilient means to retract the spike members and subsequently release said spike members at required positions in a closed loop defined by said endless band and traversed by the rods.

5. A bag opening machine according to claim 4 wherein said endless band comprises two transversely spaced endless chains carried by rear and forward sprocket wheels comprising said guide rollers and a plurality of spaced transverse slats extending between said chains.

6. A bag opening machine according to claim 1, wherein said cutting means comprises two cutters which are arranged for movement in said conveying direction and laterally to said direction conveying direction to opposite sides respectively of said conveyor, including resilient means which act to urge the cutters inwardly and rearwardly, one of said cutters being located behind the other in said direction conveying whereby each cutter engages each bag in cutting relationship in precisely the same position on the bag surface to ensure a continuous cut around three sides of the bag.

7. A bag opening machine according to claim 6 wherein each cutter comprises a cutting disc disposed in a plane parallel with an upper conveying surface of said endless band.

8. A bag opening machine according to claim 1 including rotatable brush means adapted to engage an inside surface of the bag envelope as it is unfolded and emptied.

9. The bag opening machine of claim 1 wherein at least some of the spike members are angled in said conveying direction and wherein said bag conveying surface of said conveyor extends substantially horizontally immediately upstream of said cutting means.

10. A bag opening machine according to claim 9, wherein said endless band includes transversely extending rods rotatable relative to said conveying surface of the band and carrying said spike members, said endless band including cam means and resilient means urging said rods to a position where the spike members protrude outwardly from the conveying surface, and a cam follower member associated with each said rod each said cam follower member cooperating with said cam means such that the rods are rotated against the action of said resilient means to retract the spike members and subsequently released at the required positions in a closed loop defined by said endless band and traversed by the rods.

* * * * *